US006679173B2

(12) United States Patent
Henn et al.

(10) Patent No.: US 6,679,173 B2
(45) Date of Patent: Jan. 20, 2004

(54) METHOD OF TEMPERING OR CONTROLLING THE TEMPERATURE OF A PRINTING PRESS

(75) Inventors: Andreas Henn, Neckargemünd (DE); Jörg Heuschkel, Viernheim (DE); Christian Hieb, Neuhofen (DE); Martin Mayer, Ladenburg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/393,035

(22) Filed: Mar. 20, 2003

(65) Prior Publication Data

US 2003/0177931 A1 Sep. 25, 2003

(30) Foreign Application Priority Data

Mar. 20, 2002 (DE) ..... 102 12 274

(51) Int. Cl.[7] ..... B41F 23/04; B41F 16/00; B41F 31/00; B41L 23/00

(52) U.S. Cl. ..... 101/487; 101/148; 101/142; 101/350.3

(58) Field of Search ..... 101/487, 142, 101/148, 350.3, 349.1, 216, 350.1, 136; 399/92

(56) References Cited

U.S. PATENT DOCUMENTS

| | | | | |
|---|---|---|---|---|
| 3,956,986 A | | 5/1976 | Wirz et al. | 101/350.3 |
| 5,189,960 A | * | 3/1993 | Valentini et al. | 101/487 |
| 5,272,971 A | * | 12/1993 | Fredericks | 101/136 |
| 5,355,796 A | | 10/1994 | Kobler et al. | 101/148 |
| 5,375,518 A | * | 12/1994 | Kurz | 101/216 |
| 5,611,278 A | * | 3/1997 | Garner et al. | 101/349.1 |
| 5,749,295 A | * | 5/1998 | Kurz | 101/350.1 |
| 5,784,957 A | * | 7/1998 | Rau et al. | 101/142 |
| 5,844,208 A | * | 12/1998 | Tustaniwskyj et al. | 219/494 |
| 6,164,207 A | * | 12/2000 | Junghans | 101/487 |
| 6,202,556 B1 | * | 3/2001 | Lagger | 101/216 |
| 6,293,199 B1 | * | 9/2001 | Gasparrini et al. | 101/487 |
| 6,505,557 B2 | * | 1/2003 | Desaulniers et al. | 101/487 |
| 6,508,069 B2 | * | 1/2003 | Sibilia | 62/201 |
| 6,546,866 B1 | * | 4/2003 | Adachi et al. | 101/366 |

FOREIGN PATENT DOCUMENTS

| | | |
|---|---|---|
| DE | 19 53 590 C3 | 6/1971 |
| DE | GM 73 43 273 | 12/1975 |
| DE | 39 04 854 C1 | 4/1990 |
| DE | 42 11 379 C2 | 10/1993 |
| DE | 44 31 188 C2 | 5/1995 |
| DE | 198 37 174 A1 | 4/1999 |
| GB | 1 242 095 | 8/1971 |

* cited by examiner

*Primary Examiner*—Charles H. Nolan, Jr.
*Assistant Examiner*—Wasseem H. Hamdan
(74) *Attorney, Agent, or Firm*—Laurence A. Greenberg; Werner H. Stemer; Ralph E. Locher

(57) ABSTRACT

A method of tempering a printing press with a circulating tempering medium includes regulating a temperature of the tempering medium. The temperature at a first measurement location is measured for purposes of control during production printing by the printing press. The temperature at a second measurement location is measured during a tempering phase of the printing press preceding production printing.

6 Claims, 1 Drawing Sheet

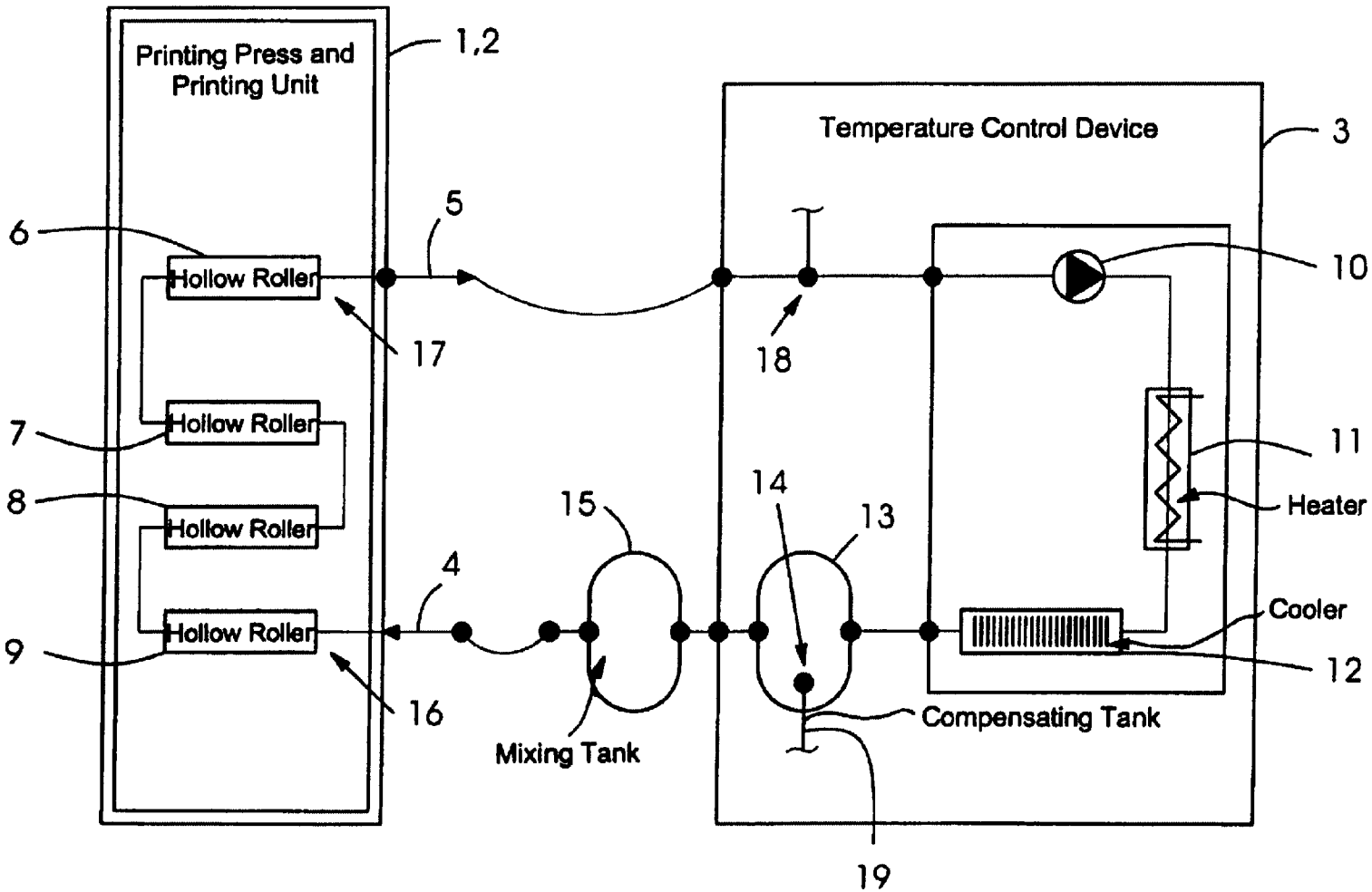
Temperature Control Device
Heater
Cooler
Compensating Tank
Mixing Tank
Printing Press and Printing Unit
Hollow Roller
Hollow Roller
Hollow Roller
Hollow Roller
1,2
3
4
5
6
7
8
9
10
11
12
13
14
15
16
17
18
19

METHOD OF TEMPERING OR CONTROLLING THE TEMPERATURE OF A PRINTING PRESS

BACKGROUND OF THE INVENTION

Field of the Invention

The invention relates to a method of tempering or controlling the temperature of a printing press by a circulating temperature control medium, the temperature of which is regulated.

It is necessary to temper or control the temperature of a printing press in order to maintain the temperature-dependent viscosity of the printing ink processed in the printing press approximately constant. Otherwise, excessively large fluctuations in the viscosity of the printing ink would manifest themselves in the form of excessively large fluctuations in the optical color density measurable in the printed image.

For a very long time heretofore, efforts have been made for improving the temperature control of printing presses, as documented by the following, briefly described publications of the prior art.

British Patent 1 242 095 describes a method wherein a temperature measuring sensor is assigned to a feedline and forerunning flow line, respectively, for a temperature control medium.

German Utility Model DE-U 73 43 273 describes an inking unit wherein the temperature of a tempering or temperature control medium emerging from rollers is measured by measuring sensors which are assigned to respective discharge and return lines.

German Patent DE 42 11 379 C2, corresponding to U.S. Pat. No. 5,355,796, makes reference to temperature registration or determination by inserting thermocouples into a cooling system, and measuring the temperatures of the coolant respectively supplied and discharged.

German Published, Non-Prosecuted Patent Application DE 198 37 174 A1, corresponding to U.S. Pat. No. 6,164,207, describes the state of the art to which reference is made in the first paragraph of the introduction hereto. In that publication, a method of temperature control is described wherein a mixing container is provided to which machine oil flowing back from an ink duct roller and serving as a tempering or temperature control medium is supplied and into which machine oil having a temperature controlled by a cooling assembly is also introduced. A temperature measuring sensor and a temperature regulating device are also used in order to implement the method.

All of the prior art cited hereinbefore is unable to satisfactorily solve a problem in the tempering or temperature control of printing presses, which has existed for a relatively long time. The problem is that, on the one hand, a very long preheating and warm-up phase is required until the temperature of the press has been tempered or controlled to the required operating temperature thereof, if only the flow temperature of the tempering or temperature control medium supplied to one printing unit of the printing press serves as the measurement and control parameter in the tempering or temperature control. On the other hand, temperature fluctuations of up to 7 Kelvin of the tempering or temperature control medium are to be expected, which in turn cause intolerably large optical color density fluctuations in the printed image if, during the tempering or control of the temperature, only the return temperature of the tempering or temperature control medium discharged from the printing unit is used as a measurement and control parameter.

A similar problem exists in printing presses which are set up at locations with ambient temperatures above the operating temperature of the printing press and, therefore, require a respective precooling and cooling operating phase preceding production printing, the respective phase serving for adjusting the operating temperature. The precooling and cooling operating phase, during which the temperature control medium (in that case a cooling liquid) is circulated through the printing press while printing cannot yet be performed because the printing press temperature has not yet fallen sufficiently, lasts too long in the heretoforeknown methods.

SUMMARY OF THE INVENTION

It is accordingly an object of the invention to provide a method of tempering or controlling the temperature of a printing press, which overcomes the hereinafore-mentioned disadvantages of the heretofore-known methods of this general type and in which, during production printing, only tolerably small temperature fluctuations occur and the temperature control phase (cooling or warm-up operating phase) preceding production printing is not unnecessarily long.

With the foregoing and other objects in view, there is provided, in accordance with the invention, a method of tempering a printing press by a circulating tempering medium, which comprises regulating a temperature of the tempering medium. The temperature at a first measurement location is measured for purposes of control during production printing by the printing press. The temperature at a second measurement location is measured during a tempering phase of the printing press preceding production printing.

In accordance with another mode, the method invention further includes providing a control device for regulating the temperature. The control device is changed over automatically from measuring at the second measurement location to measuring at the first measurement location the instant that the temperature deviates from a temperature limiting value prescribed for the control device.

In accordance with a further mode, the method invention further includes providing the first measurement location between a heater and an inlet for the tempering medium. The tempering medium is heated with the heater.

In accordance with an added mode, the method invention further includes providing the second measurement location between an outlet for the tempering medium and a heater. The tempering medium is heated with the heater.

In accordance with an additional mode, the method invention further includes providing the first measurement location between a cooler and an inlet for the tempering medium. The tempering medium is cooled by the cooler.

In accordance with yet another mode, the method invention further includes providing the second measurement location between an outlet for the tempering medium and the cooler. The tempering medium is cooled by the cooler.

In accordance with a concomitant mode, the method invention further includes providing a mixing tank for the tempering medium between the first measurement location and an inlet for the tempering medium. Temperature fluctuations of the tempering medium in the mixing tank for the tempering medium are damped.

The method according to the present invention is of the general type referred to in the introduction hereto but advantageously calls for measuring the temperature at a first measurement location for control during production printing. The temperature at a second measurement location is measured during a temperature control phase (cooling or warm-up phase) of the printing press, which precedes the production printing.

In the method according to the invention, the respective disadvantages of the flow measurement and flow temperature control heretofore known from the prior art, and of the return measurement or return temperature control likewise known heretofore from the prior art, are eliminated.

Through the use of the respective control and regulation strategy upon which the method invention is based, on the one hand, unnecessary prolongation of the tempering or temperature control phase of the printing press is avoided and, on the other hand, assurance is provided that the temperature of the tempering or temperature control medium only fluctuates extremely slightly during production printing.

It is inherent in the method according to the invention that the temperature of the tempering or temperature control medium can never be controlled or regulated from measured values measured simultaneously at the two measurement locations. Although it is possible for the temperatures to be measured simultaneously at both measurement locations, at the instant of the simultaneous measurement of the temperatures, it is always only one of the measured values obtained at the two measurement locations which is used for the control or regulation of the temperature of the tempering or temperature control medium. If, at a specific instant, the temperature of the tempering or temperature control medium is regulated based upon the measured value obtained at the first measurement location, then the measured value possibly obtained at this instant at the second measurement location is not used for regulating the temperature. If, at a different instant, the temperature of the tempering or temperature control medium is controlled based upon a measured value obtained at the second measurement location, then the measured value possibly obtained at the last-mentioned instant at the first measurement location is not used to control the temperature of the tempering or temperature control medium. Stated in other words, although the two measurement locations are used chronologically after one another, they are never used simultaneously for obtaining the measured values required for the control or regulation.

In a development which is advantageous with regard to relieving the load on the operating personnel for operational interventions, the temperature of the tempering or temperature control medium is regulated by a control device which is configured so that it switches or changes over automatically from using the second measurement location to using the first measurement location the instant the measured temperature either exceeds a temperature limiting value prescribed for the control device (if the temperature control phase is a warm-up phase) or falls below the temperature limiting value (if the temperature control phase is a cooling phase).

In a development which is advantageous with regard to controlling the flow temperature of the tempering or temperature control medium, in a manner unaffected by a printing unit of the printing press, during production printing, a heater serving to heat the tempering or temperature control medium (and/or a cooler serving to cool the tempering or temperature control medium) is provided between the first measurement location that is used and an inlet for the temperature control medium. The printing unit temperature, which fluctuates as a function of machine speeds of the printing unit, for example, can therefore no longer have a detrimental effect as a disruptive variable on the quality and accuracy of the temperature regulation of the tempering or temperature control medium in production printing. The aforementioned inlet for the tempering or temperature control medium is a printing unit inlet, preferably an inking unit inlet and, for example, a roller inlet.

In a development which is advantageous with regard to the use of a comparatively inexpensive control device for regulating the temperature of the tempering or temperature control medium, in order to damp temperature fluctuations of the tempering or temperature control medium supplied to the printing unit, use is made of a mixing tank or container for the tempering or temperature control medium, disposed between the first measurement location and the inlet. The temperature fluctuations, the magnitude of which depends upon the control accuracy of the regulating device, necessarily occur in each control device. The higher the requirements for the control accuracy and therefore the lower the temperature fluctuations, the more expensive is the requisite control device. As a result of the presence and the selected configuration of the mixing tank and the compensating tank connected directly upstream of the mixing tank, the temperature fluctuations necessarily caused by the existing control device are compensated for to the greatest possible extent, so that the requirements on the control accuracy of the existing control device can be kept low, and a comparatively inexpensive control device can be used as the latter. Although the existing control device needs to be only a particularly inexpensive two-point control device, for example, it is possible with such a device to achieve a high control accuracy, which is equivalent to the control accuracy of a much more expensive servocontroller, which is therefore not required.

In a development which is advantageous with regard to taking into account the rise in the printing unit temperature during the warm-up phase for controlling the temperature of the tempering or temperature control medium, the second measurement location that is used is disposed between an outlet for the temperature control medium and the heater that is used for heating the tempering or temperature control medium.

In a development which is advantageous with regard to taking into account the drop in the printing unit temperature during the cooling phase for controlling the temperature of the tempering or temperature control medium, the second measurement location that is used is disposed between an outlet for the temperature control medium and the cooler used for cooling the tempering or temperature control medium.

In both the developments just mentioned hereinbefore, the outlet for the temperature control medium is, respectively, a printing unit outlet, preferably an inking unit outlet and, for example, a roller outlet.

Other features which are considered as characteristic for the invention are set forth in the appended claims.

Although the invention is illustrated and described herein as embodied in a method of tempering or controlling the temperature of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single figure of the drawing.

BRIEF DESCRIPTION OF THE DRAWING

The FIGURE of the drawing is a schematic and diagrammatic plan view of a device for performing a method of tempering or controlling the temperature of a printing machine in accordance with the invention.

DESCRIPTION OF THE PREFERRED EMBODIMENTS

Referring now in detail to the single figure of the drawing, there is seen a schematic and diagrammatic illustration of a printing press 1 including a printing unit 2, more specifically an offset printing unit, and a tempering or temperature control device 3. The tempering or temperature control device 3 is disposed beside the printing unit 2 and, via a flow line 4 and a return line 5, is connected to hollow rollers 6 to 9 of the printing unit 2 so as to form a tempering or temperature control medium circulating system through which a liquid tempering or temperature control medium, specifically water, flows.

The hollow rollers 6 to 9 are an ink duct roller 6 and axially oscillating distributor rollers 7 to 9 of an inking unit, and are mutually connected serially via connecting lines. These connecting lines, and likewise the flow line 4 and the return line 5, are hoses or pipes.

The tempering or temperature control device 3 includes a pump 10, a heater (continuous flow heater) 11 and a cooler 12, which are likewise serially connected to one another via connecting lines of the aforementioned type. In addition, the tempering or temperature control device includes a compensating tank 13, wherein there is a first measuring sensor, accordingly, a first measurement location 14.

A mixing tank 15 is integrated in the flow line 4, specifically between the compensating tank 13 and an inlet 16 of the roller 9, through which the tempering or temperature control medium flows into the roller 9. Integrated in the return line 5 which begins at an outlet 17 of the roller 6, through which the tempering or temperature control medium flows out of the roller 6, is a second measuring sensor disposed at a second measurement location 18.

The two measurement locations 14 and 18 belong to a diagrammatically illustrated control device 19, by which the temperature of the tempering or temperature control medium and, consequently, the temperature of the rollers 6 to 9 and of the printing ink transported thereon are regulatable.

The control device 19 forms a closed control loop and activates the heater 11, the cooler 12 and, if necessary or desirable, a pump 10.

Within the circulating system for the tempering or temperature control medium, the mixing tank 15 and the first measurement location 14 are disposed downstream from the pump 10, the heater 11 and the cooler 12, and upstream of the inlet 16, and the second measurement location 18 is disposed downstream of the outlet 17 and upstream of the pump 10, the heater 11 and the cooler 12, all as viewed with regard to the flow direction of the tempering or temperature control medium. The mixing tank 15 is located within the circulating system for the tempering or temperature control medium, between the first measurement location 14 and the inlet 16.

The printing press 1 is operated in accordance with the following method:

After a relatively long pause in operation, for example, when the printing press 1 has been out of operation overnight, the printing press 1 is switched on, thereby activating a motor that moves the rollers 6 to 9, the pump 10 pumping the tempering or temperature control medium through the circulating system therefor, and the heater 11.

At this instant of the startup period, the so-called "cold start", the temperature of the tempering or temperature control medium, measured by the control device 19 through the intermediary of the second measuring sensor at the second measurement location 18, corresponds to the ambient temperature of 20° C., for example, i.e., the tempering or temperature control medium has not yet reached the operating temperature of 35° C., for example, required for production printing.

In order to reach this operating temperature, a warm-up phase is required, during which the circulating tempering or temperature control medium is heated gradually by the heater 11. During this warm-up phase, the control device 19 is operated in a mode which is called "return measurement and return tempering or temperature control", respectively, for which, it is typical that the rising temperature of the tempering or temperature control medium is measured by the control device 19 exclusively at the second measurement location 18. Stated in other words, in the operating mode "return measurement and return tempering or temperature control", respectively, only the temperature measured at the second measurement location 18 is used as a measured variable (actual value) of the control device 19. During the aforementioned warm-up phase, the control device 19, of course, keeps the cooler 12 in an inactive state and only the heater 11 in the active state, the heater 11 heating the tempering or temperature control medium to a flow temperature lying above 30° C., which the tempering or temperature control medium inherently has at the instant at which it enters the printing unit 2.

At the beginning of the warm-up phase, the tempering or temperature control medium surrenders the major part of the heat picked up from the heater 11 to the yet cold rollers 6 to 9, so that the return temperature of the tempering or temperature control medium registered at the second measurement location 18 is lower than the flow temperature thereof. At the end of the warm-up phase, the rollers 6 to 9 have already heated up, for example, due to bearing friction, to such an extent that the rollers 6 to 9 surrender heat to the tempering or temperature control medium flowing through the rollers 6 to 9, so that the return temperature registered at the second measurement location 18 is higher than the flow temperature and, at 35° C., for example, corresponds exactly to the required operating temperature or at least lies within a defined permissible tolerance range or band of this operating temperature and does not fall below a lower limit of this tolerance range.

The instant that the control device 19 detects when the tempering or temperature control medium has reached the required operating temperature, the control device 19 automatically changes over from the operating mode "return measurement and return tempering or temperature control", respectively, thereof, into an operating mode "flow measurement and flow tempering or temperature control", respectively.

In the operating mode "flow measurement or flow temperature control", the temperature of the temperature control medium is no longer registered by the control device 19 at the second measurement location 18 but instead only at the first measurement location 14, and the temperature measured at the first measurement location 14 by the first measuring sensor is used as measured variable (actual value) for the control.

It is then possible to begin production printing, during which the control device 19 operates exclusively in the operating mode "flow measurement and flow tempering or temperature control", respectively, and in the event of excessive heating of the circulating tempering or temperature control medium, switches off the heater 11 and switches on the cooler 12.

During production printing, temperature fluctuations of the advance flow temperature, i.e., the temperature which the tempering or temperature control medium has immediately before entry thereof into the printing unit 2, is compensated for by the mixing tank 15, wherein the temperature fluctuations are mixed with one another in accordance with slightly different, tempered or temperature-controlled volumes of tempered or temperature control medium.

In the method described hereinbefore, according to which the printing press 1 is controlled and operated, assurance is always provided that, during production printing, the printing unit 2 is supplied by the tempering or temperature control device 3 with the tempering or temperature control medium which, in this regard, is subject to only extremely minimal, defined temperature fluctuations, so that the optical color density fluctuations necessarily resulting from the temperature fluctuations and measurable in the printing image are kept within tolerable limits and are virtually negligibly small.

Of course, the warm-up phase is dispensed with when the printing press 1 is started up again, i.e., by a so-called "warm start", which follows a short printing interruption (stopper). During the "warm start", there is provided, at the second measurement location 18, a temperature of the tempering or temperature control medium already corresponding to the operating temperature or, within the aforementioned tolerance range or band of the operating temperature, slightly above the latter, so that the control device 19 automatically switches immediately into the operating mode "flow measurement and flow tempering or temperature control", respectively, and maintains the latter, respectively.

We claim:

1. A method of tempering a printing press, which comprises:

circulating a tempering medium; and regulating a temperature of the tempering medium by:

measuring a temperature at a first measurement location for purposes of control, during production printing by the printing press; and measuring a temperature at a second measurement location, during a tempering phase of the printing press preceding production printing; and providing a control device for regulating the temperature; and automatically changing over the control device from measuring at the second measurement location to measuring at the first measurement location at the instant that the temperature deviates from a temperature limiting value prescribed for the control device.

2. The method according to claim 1, which further comprises:

providing the first measurement location between a heater and an inlet for the tempering medium; and heating the tempering medium with the heater.

3. The method according to claim 1, which further comprises:

providing the second measurement location between an outlet for the tempering medium and a heater; and heating the tempering medium with the heater.

4. The method according to claim 1, which further comprises:

providing the first measurement location between a cooler and an inlet for the tempering medium; and cooling the tempering medium with the cooler.

5. The method according to claim 1, which further comprises:

providing the second measurement location between an outlet for the tempering medium and a cooler; and cooling the tempering medium with the cooler.

6. The method according to claim 1, which further comprises:

providing a mixing tank for the tempering medium between the first measurement location and an inlet for the tempering medium; and damping temperature fluctuations of the tempering medium in the mixing tank for the tempering medium.

* * * * *